US010738561B2

(12) United States Patent
Kobayashi et al.

(10) Patent No.: US 10,738,561 B2
(45) Date of Patent: Aug. 11, 2020

(54) STOCK SHAPE FOR DOWNHOLE TOOL COMPONENT, DOWNHOLE TOOL COMPONENT, AND DOWNHOLE TOOL

(71) Applicant: Kureha Corporation, Tokyo (JP)

(72) Inventors: Fuminori Kobayashi, Tokyo (JP); Masayuki Okura, Tokyo (JP); Takeo Takahashi, Tokyo (JP)

(73) Assignee: KUREHA CORPORATION, Tokyo (JP)

( * ) Notice: Subject to any disclaimer, the term of this patent is extended or adjusted under 35 U.S.C. 154(b) by 160 days.

(21) Appl. No.: 16/065,838

(22) PCT Filed: Dec. 26, 2016

(86) PCT No.: PCT/JP2016/088681
§ 371 (c)(1),
(2) Date: Jun. 25, 2018

(87) PCT Pub. No.: WO2017/111159
PCT Pub. Date: Jun. 29, 2017

(65) Prior Publication Data

US 2019/0017346 A1 Jan. 17, 2019

(30) Foreign Application Priority Data

Dec. 25, 2015 (JP) ..... 2015-255372

(51) Int. Cl.
*C22C 23/06* (2006.01)
*E21B 33/12* (2006.01)
(Continued)

(52) U.S. Cl.
CPC ..... *E21B 33/1208* (2013.01); *B21C 23/00* (2013.01); *B21C 23/002* (2013.01);
(Continued)

(58) Field of Classification Search
CPC ..... C22C 23/02; C22C 23/06; C22C 23/00
See application file for complete search history.

(56) References Cited

U.S. PATENT DOCUMENTS 6,767,506 B2 * 7/2004 Bronfin ..... C22C 23/06 420/411
9,017,604 B2 * 4/2015 Lyon ..... C22F 1/06 420/406
(Continued)

FOREIGN PATENT DOCUMENTS

CA 2 954 126 A1 2/2016
CN 103898384 A 7/2014
(Continued)

OTHER PUBLICATIONS

Translation of the International Search Report for PCT/JP2016/088681 dated Mar. 14, 2017.
(Continued)

*Primary Examiner* — Kenneth L Thompson
(74) *Attorney, Agent, or Firm* — Birch, Stewart, Kolasch & Birch, LLP

(57) ABSTRACT

A stock shape for a downhole tool component includes a magnesium alloy including a phase containing 70 to 95 wt. % of magnesium in which 0 wt. % or more and less than 0.3 wt. % of a rare earth metal, a metal material other than the magnesium and the rare earth metal, and 0.1 to 20 wt. % of a degradation accelerator are distributed, and the stock shape has an average particle size of the metal material of 1 to 300 μm, tensile strength of 200 to 500 MPa, and a degradation rate in a 2% potassium chloride aqueous solution at 93° C. of not less than 20 mg/cm$^2$ and not greater than 20000 mg/cm$^2$ per day. Accordingly, a downhole tool having high strength and being readily degradable is established.

21 Claims, 1 Drawing Sheet

(51) Int. Cl.

| | |
|---|---|
| ***B22D 21/04*** | (2006.01) |
| ***C22C 23/02*** | (2006.01) |
| ***C22F 1/06*** | (2006.01) |
| ***B21C 23/00*** | (2006.01) |
| ***E21B 33/128*** | (2006.01) |
| ***E21B 33/134*** | (2006.01) |
| ***E21B 43/26*** | (2006.01) |
| *C22F 1/00* | (2006.01) |

(52) U.S. Cl.

CPC ..... *B22D 21/04* (2013.01); *C22C 23/02* (2013.01); *C22F 1/06* (2013.01); *E21B 33/12* (2013.01); *E21B 33/128* (2013.01); *E21B 33/134* (2013.01); *E21B 43/26* (2013.01); *C22F 1/00* (2013.01)

(56) References Cited

U.S. PATENT DOCUMENTS

| | | | | |
|---|---|---|---|---|
| 9,775,647 | B2 * | 10/2017 | Schiffl | C22C 23/04 |
| 10,337,086 | B2 * | 7/2019 | Wilks | C22C 23/06 |
| 2012/0006561 | A1 | 1/2012 | Johnson et al. | |
| 2012/0006562 | A1 | 1/2012 | Speer et al. | |
| 2014/0174728 | A1 | 6/2014 | Speer et al. | |
| 2014/0251691 | A1 | 9/2014 | Evans | |
| 2014/0262327 | A1 * | 9/2014 | Xu | B22F 1/025 166/376 |
| 2016/0230494 | A1 * | 8/2016 | Fripp | C22C 23/04 |
| 2016/0237530 | A1 | 8/2016 | Roy et al. | |
| 2016/0237774 | A1 | 8/2016 | Okura et al. | |
| 2018/0202027 | A1 * | 7/2018 | Wilks | B22D 21/007 |
| 2018/0216431 | A1 * | 8/2018 | Walton, III | E21B 23/06 |

FOREIGN PATENT DOCUMENTS

| | | | |
|---|---|---|---|
| CN | 104004950 | A | 8/2014 |
| CN | 104651691 | A | 5/2015 |
| EP | 3 175 010 | A2 | 6/2017 |
| JP | 2015151692 | A | 8/2015 |
| RU | 2 542 022 | C2 | 8/2014 |
| WO | WO2015057755 | A1 | 4/2015 |
| WO | WO2015060246 | A1 | 4/2015 |

OTHER PUBLICATIONS

Kanamori, Yoichi et al., Mechanical Properties and Microstructure of Forged Castings of AZ91 Magnesium Alloy, Mie-ken Kagaku Gijutsu Shinkou Center Kogyo Kenkyu-bu Kenkyu Houkoku, No. 31, 2007, pp. 30-35.

Kariya, Shota et al., Materials Design for Corrosion Rate Control in PM AZ91 Mg Alloy by Fe Addtion, Transactions of JWRI, vol. 43, No. 2, Dec. 2014, pp. 31-36, ISSN 0387-4508.

Office Action dated Feb. 11, 2019, in Russian Patent Application No. 2018122482/02(035553), with English translation.

Extended European Search Report dated Sep. 20, 2018, in European Patent Application No. 16897043.4.

Office Action dated Jun. 27, 2019, in Chinese Patent Application No. 201680073145.1.

English translation of International Preliminary Report on Patentability dated Jul. 5, 2018, in PCT/JP2016/088681 (Forms PCT/IB/338, PCT/IB/373, and PCT/ISA/237).

Communication Pursuant to Article 94(3) EPC dated Aug. 23, 2019, in European Patent Application No. 16 879 043.4.

Office Action dated Aug. 12, 2019, in Canadian Patent Application No. 3,008,591.

Canadian Office Action, dated Feb. 12, 2020 for Canadian Application No. 3,008,591.

Chinese Office Action, dated Feb. 21, 2020 for Chinese Application No. 201680073145.1 with an English translation.

European Office Action dated Apr. 17, 2020, for corresponding European Patent Application No. 16879043.4.

* cited by examiner

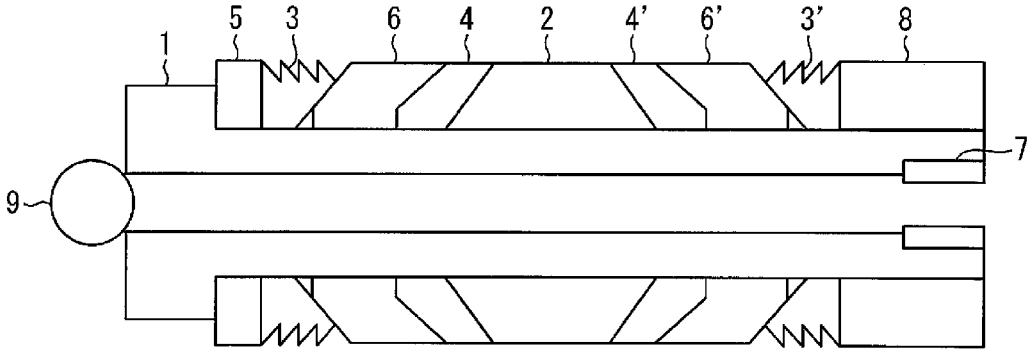
5
3
6
4
2
4'
6'
3'
8
1
7
9

STOCK SHAPE FOR DOWNHOLE TOOL COMPONENT, DOWNHOLE TOOL COMPONENT, AND DOWNHOLE TOOL

TECHNICAL FIELD

The present invention relates to a stock shape for a downhole tool component, a downhole tool component, and a downhole tool.

BACKGROUND ART

A hydrocarbon resource such as petroleum or natural gas is recovered and produced from a well (an oil well or a gas well; may collectively be referred to as a "well") including a porous and permeable subterranean formation. A downhole tool serving as a device configured to form a hole for forming such a well (in other words, a hole provided to form a well; may be referred to as a "downhole") is used in high-temperature, high-pressure environments. Thus, each component constituting the downhole tool also need to have high strength. Furthermore, since the downhole tool is difficult to extract after use, a downhole tool component used in isolation and sealing applications needs to be degradable and removable in a location of use.

A component using a degradable resin or rubber has been used as the degradable and removable downhole tool component, but may have insufficient strength and heat resistance, and a metal or a non-degradable resin may be used for a component that needs to have high strength or high heat resistance. When the component including a metal or a non-degradable resin is used, the component needs to be broken into small fragments by milling or the like to be retrieved, and a cost and labor increase. Furthermore, a milling defect and a retrieval failure may cause production impediment. Furthermore, in the case of a downhole tool including a combination of a degradable resin or rubber and a non-degradable metal or resin, the non-degradable component remains in a well, and may cause production impediment. Thus, there is a demand for a metal component readily degradable after use.

Patent Documents 1 and 2 each describe use of a magnesium alloy material containing aluminum, lithium, calcium, yttrium, and the like in a product for subterranean work such as a petroleum well or a natural gas well, and each describe quick degradation of this magnesium alloy material.

Patent Document 3 describes a plug that is a downhole tool using a slip and a mandrel made of a magnesium alloy.

Patent Document 4 describes a magnesium alloy cast forged material having a reduced weight and being excellent in strength.

CITATION LIST

Patent Document

Patent Document 1: Chinese Patent Publication No. 104004950 (published Aug. 27, 2014)

Patent Document 2: Chinese Patent Publication No. 104651691 (published May 27, 2015)

Patent Document 3: US 2014/0251691 A (published Sep. 11, 2014)

Non-Patent Document

Non-Patent Document 1: Yoichi KANAMORI, Katsuya HIO, Mie Prefectural Science and Technology Promotion Center, Industrial Research Division Research Report, No. 31, pp. 30-35, 2007

SUMMARY OF INVENTION

Technical Problems

As described above, a component for a downhole tool needs to have high strength and also to be readily degradable.

The magnesium alloy material described in Patent Document 1 has been developed to improve a degradation rate without particular consideration for strength. It is difficult to obtain a magnesium alloy material having strength sufficient for a downhole tool simply by defining metal material components and contents in the magnesium alloy material.

Furthermore, the magnesium alloy material described in Patent Document 2 contains yttrium for increasing strength. A rare earth metal such as yttrium is expensive, and thus, when the magnesium alloy material contains a rare earth metal, a material cost increases. Furthermore, a magnesium alloy material containing a rare earth metal is extremely hard, and thus is difficult to process. Furthermore, such a magnesium alloy material is difficult to process, and thus a processing cost also increases.

Patent Document 3 only describes use of a magnesium alloy in forming a downhole tool, and does not describe establishment of a downhole tool having high strength and being readily degradable.

Furthermore, Non-Patent Document 1 does not describe use of a magnesium alloy cast forged material as a downhole tool nor degradability of a component formed by using this material. That is, Non-Patent Document 1 does not describe establishment of a downhole tool having high strength and being readily degradable.

An aspect of the present invention is made in light of the above problems, and an objective of an aspect of the present invention is to establish a stock shape for a downhole tool component for forming a downhole tool component having high strength and being also readily degradable, and further to provide a downhole tool component using the stock shape, a downhole tool, a well treatment method, and a method of producing the stock shape.

Solution to Problems

To solve the above problems, a stock shape for a downhole tool component according to an aspect of the present invention includes a magnesium alloy including a phase containing not less than 70 wt. % and not greater than 95 wt. % of magnesium in which not less than 0 wt. % and less than 0.3 wt. % of a rare earth metal, a metal material other than the magnesium and the rare earth metal, and not less than 0.1 wt. % and not greater than 20 wt. % of a degradation accelerator are distributed, and the stock shape has an average crystal grain size of the magnesium alloy of not less than 0.1 μm and not greater than 300 μm, tensile strength of not less than 200 MPa and not greater than 500 MPa, and a degradation rate in a 2% potassium chloride aqueous solution at 93° C. of not less than 20 mg/cm$^2$ and not greater than 20000 mg/cm$^2$ per day.

A downhole tool component according to an aspect of the present invention is formed with the above stock shape for a downhole tool component.

A downhole tool according to an aspect of the present invention includes the above downhole tool component.

A well treatment method according to an aspect of the present invention uses the above downhole tool.

A stock shape for a downhole tool component according to an aspect of the present invention includes a magnesium alloy including a phase containing not less than 70 wt. % and not greater than 95 wt. % of magnesium in which not less than 0 wt. % and less than 0.3 wt. % of a rare earth metal and a metal material other than the magnesium and the rare earth metal are distributed, and the stock shape has an average crystal grain size of the magnesium alloy of not less than 0.1 μm and not greater than 300 μm, and tensile strength of not less than 200 MPa and not greater than 500 MPa.

Advantageous Effects of Invention

The stock shape for a downhole tool component according to an aspect of the present invention has the average crystal grain size of the magnesium alloy of not less than 0.1 μm and not greater than 300 μm and the content of the degradation accelerator of not less than 0.1 wt. % and not greater than 20 wt. %, and thus, the stock shape has high strength of not less than 200 MPa and not greater than 500 MPa corresponding to tensile strength suitable for well drilling, and is also readily degradable.

BRIEF DESCRIPTION OF THE DRAWINGS

The FIGURE is a schematic view illustrating a specific example of a downhole tool according to an aspect of the present invention.

DESCRIPTION OF EMBODIMENTS

Stock Shape for Downhole Tool Component

A stock shape for a downhole tool component according to an aspect of the present invention includes a magnesium alloy including a phase containing not less than 70 wt. % and not greater than 95 wt. % of magnesium in which not less than 0 wt. % and less than 0.3 wt. % of a rare earth metal, a metal material other than the magnesium and the rare earth metal, and not less than 0.1 wt. % and not greater than 20 wt. % of a degradation accelerator are distributed, and the stock shape has an average crystal grain size of the magnesium alloy of not less than 0.1 μm and not greater than 300 μm, and tensile strength of not less than 200 MPa and not greater than 500 MPa. Furthermore, the stock shape for a downhole tool component according to an aspect of the present invention has a degradation rate in a 2% potassium chloride aqueous solution at 93° C. of not less than 20 mg/cm$^2$ and not greater than 20000 mg/cm$^2$ per day. The stock shape for a downhole tool component according to an aspect of the present invention may simply be referred to as a stock shape hereinafter.

The stock shape has high strength of not less than 200 MPa and not greater than 500 MPa corresponding to tensile strength suitable for well drilling, and is also readily degradable in an aqueous solution of chloride such as potassium chloride (KCl). Therefore, the stock shape is favorably used for forming a downhole tool component constituting a downhole tool used in well drilling. Furthermore, even though the stock shape includes a small amount of a rare earth metal or no rare earth metal that is generally added to increase strength, the stock shape obtains sufficient strength. Thus, the stock shape is easy to process and can also reduce costs of a material and of processing. Here, the stock shape having high strength refers to a stock shape having high tensile strength, and can be a stock shape having a high load capacity and having increased yield strength and an increased compressive strength due to high tensile strength.

Magnesium Alloy

The stock shape includes a magnesium alloy containing magnesium as a main component. A content of the magnesium in the magnesium alloy is not less than 70 wt. % and not greater than 95 wt. % with respect to a total of the magnesium alloy. Accordingly, while the stock shape has a reduced weight, the stock shape can obtain certain strength.

Metal Material and Degradation Accelerator

The magnesium alloy further includes, in addition to the magnesium and the rare earth metal, another metal material than the magnesium and the rare earth metal. This metal material includes a metal material serving as a degradation accelerator for promoting degradation of magnesium, and a metal material other than the degradation accelerator, and the magnesium alloy includes both the degradation accelerator and the metal material. That is, the magnesium alloy further includes the metal material and the degradation accelerator, other than the magnesium and the rare earth metal. The magnesium alloy includes the metal material other than the degradation accelerator, and accordingly, the stock shape can obtain high strength.

The metal material other than the degradation accelerator of the other metal material than the magnesium and the rare earth metal is not particularly limited as long as the metal material is a metal other than the magnesium and the rare earth metal, but is preferably at least one metal selected from the group consisting of aluminum and zirconium. Furthermore, the magnesium alloy may include one of the metal material other than the degradation accelerator, but more preferably includes two or more of the metal materials. The magnesium alloy may further include manganese, silicon, lithium, and the like as the metal material other than the degradation accelerator. A total content of the metal material other than the degradation accelerator in the magnesium alloy is preferably not less than 3 wt. % and not greater than 20 wt. %, more preferably not less than 4 wt. % and not greater than 18 wt. %, and even more preferably not less than 5 wt. % and not greater than 15 wt. %, with respect to a total of the magnesium alloy.

The magnesium alloy preferably includes aluminum alone, aluminum and manganese, or aluminum and zirconium as the metal material other than the degradation accelerator, but more preferably includes aluminum alone as the metal material other than the degradation accelerator. Accordingly, the stock shape can have higher strength and also improved plasticity.

The metal material serving as the degradation accelerator of the other metal material than the magnesium and the rare earth metal refers to a metal material having a large potential difference from magnesium to accelerate corrosion of magnesium. Examples of the metal material serving as the degradation accelerator include iron, nickel, copper, cobalt, zinc, cadmium, calcium, and silver. The magnesium alloy more preferably includes, as the metal material serving as the degradation accelerator, at least one metal selected from the group consisting of zinc, calcium, iron, nickel, copper, and cobalt, and even more preferably at least one metal selected from the group consisting of iron, nickel, copper, and cobalt. Accordingly, the stock shape is more readily degradable.

Furthermore, since zinc, calcium, and copper each have a high strength improvement effect of the magnesium alloy, the magnesium alloy particularly preferably includes zinc, calcium, and copper as the metal material serving as the degradation accelerator. Further, calcium has an effect of increasing an ignition temperature of the magnesium alloy and making the magnesium alloy flame retardant. The magnesium alloy may include a combination of aluminum and zinc, aluminum and calcium, or aluminum, zinc, and calcium as the metal material serving as the degradation accelerator.

A content of the metal material serving as the degradation accelerator in the magnesium alloy is not less than 0.1 wt. % and not greater than 20 wt. % with respect to a total of the magnesium alloy, but when the metal material serving as the degradation accelerator includes at least one selected from the group consisting of iron, nickel, copper, and cobalt, the content of the metal material serving as the degradation accelerator in the magnesium alloy may be not less than 0.01 wt. % and not greater than 20 wt. %. Iron, nickel, copper, and cobalt each have a higher degradation promoting effect. Thus, when the metal material serving as the degradation accelerator includes iron, nickel, copper, and cobalt, degradation of the magnesium alloy can be favorably accelerated even when the content of the metal material serving as the degradation accelerator in the magnesium alloy is not less than 0.1 wt. %.

When the magnesium alloy includes aluminum as the metal material other than the degradation accelerator and includes zinc as the degradation accelerator, a content of the aluminum in the magnesium alloy is preferably not less than 3 wt. % and not greater than 15 wt. %, and more preferably not less than 4 wt. % and not greater than 13 wt. %, with respect to a total of the magnesium alloy. Furthermore, a content of the zinc in the magnesium alloy is preferably not less than 0.1 wt. % and not greater than 5 wt. %, and more preferably not less than 0.2 wt. % and not greater than 3 wt. %, with respect to a total of the magnesium alloy.

In the magnesium alloy, the metal material including the degradation accelerator undergoes solid solution in a phase containing magnesium, that is, in crystal grains of the magnesium or is present in a particulate form outside the crystal grains, and thus, the metal material including the degradation accelerator is distributed in the magnesium alloy. When the crystal grain size of the magnesium alloy is large, a forming defect such as a crack is likely to be generated during forming performed after casting and strength is also likely to decrease after forming, and furthermore, dispersibility of the metal material including the degradation accelerator and present in the crystal grains also decreases. Therefore, as described below, the crystal grain size of the magnesium alloy is preferably small, and furthermore, the metal material including the degradation accelerator is preferably uniformly distributed in the magnesium crystal grains or outside the crystal grains. Accordingly, the stock shape can generally obtain high strength.

Dispersibility of the metal material including the degradation accelerator in the magnesium alloy can be confirmed by using a metal microscope, a SEM, a SEM-EDX, and the like to observe a cut section of the magnesium alloy subjected to cutting. Furthermore, when the metal material including the degradation accelerator is uniformly distributed in the magnesium phase, an amount of the metal material including the degradation accelerator between pieces cut in a certain shape from the stock shape is substantially same. As a result, even a relatively large component such as a downhole tool component produced from the stock shape has favorable mechanical properties and degradability, and the stock shape is applicable to such a component without the component remaining as a large fragment upon removal.

The average particle size of the metal material including the degradation accelerator and distributed in the magnesium alloy is preferably not greater than 100 μm. The metal material including the degradation accelerator and distributed in the magnesium alloy has a certain large particle size, and accordingly contributes to the strength improvement. Therefore, the average particle size of the metal material including the degradation accelerator and distributed in the magnesium alloy is not greater than 100 μm and accordingly the stock shape can obtain high strength.

More specifically, a portion of the metal material including the degradation accelerator and distributed in the magnesium alloy undergoes solid solution, and another portion of the metal material does not undergo solid solution by casting and thermal refining (heat treatment) performed after the casting, forming such as extrusion or forging, and further heat treatment performed after the forming, and the portion without undergoing solid solution crystallizes out as a compound such as $Mg_{17}Al_{12}$, or crystallizes out alone. The compound or the metal material having thus crystallized out may cause a forming defect depending on an amount and a size of the compound or the metal material. On the other hand, a stock shape for a downhole tool having high strength and being also readily degradable can be established by appropriately adjusting the amount and the size of the compound or the metal material in a formed product.

Therefore, the metal material including the degradation accelerator and distributed in the magnesium alloy is mainly refers to the compound and the metal material having crystallized out without undergoing solid solution in the magnesium alloy. When an average particle size of the compound and the metal material having thus crystallized out is not greater than 100 μm, a stock shape for a downhole tool having high strength and being also readily degradable can be established. Note that a particle size of the metal material including the degradation accelerator and having undergone solid solution in the magnesium alloy is extremely small, as small as not greater than 1 μm, and is expected to be smaller than a particle size of the compound and the metal material having crystallized out without undergoing solid solution. A lower limit of the average particle size of the metal material including the degradation accelerator and distributed in the magnesium alloy may be set to an average particle size of the metal material having undergone solid solution.

Furthermore, the average particle size of the metal material including the degradation accelerator is as small as not greater than 100 μm, and accordingly, particles of the metal material forming a compound with magnesium or being present alone in the magnesium alloy can be present more uniformly. As a result, a downhole tool component produced from the stock shape has favorable degradation characteristics and does not remain as a large fragment upon removal.

Rare Earth Metal

The magnesium alloy includes not less than 0 wt. % and less than 0.3 wt. % of a rare earth metal. In other words, the magnesium alloy may include the rare earth metal, or may include no rare earth metal, and when the magnesium alloy includes the rare earth metal, the amount of the rare earth metal is as extremely small as less than 0.3 wt. % with respect to a total of the magnesium alloy. Since the stock shape establishes high strength due to the above metal material, the stock shape does not need to contain the rare earth metal to increase strength. That is, since the stock shape uses no rare earth metal that is expensive and difficult to process, a material cost can be reduced, and processing can be facilitated and a processing cost can be reduced.

The magnesium alloy preferably includes not greater than 0.2 wt. % of the rare earth metal, and most preferably includes no rare earth metal. An example of the rare earth metal that the magnesium alloy may include includes yttrium, but the rare earth metal is not limited to this example. When the magnesium alloy includes the rare earth metal, the rare earth metal is preferably uniformly distributed in the magnesium phase.

Average Crystal Grain Size

An average crystal grain size of the magnesium alloy is not less than 0.1 μm and not greater than 300 μm. A small average crystal grain size of the magnesium alloy contributes to strength improvement. Thus, when the average crystal grain size of the magnesium alloy is not less than 0.1 μm and not greater than 300 μm, the stock shape can obtain higher strength. Furthermore, when the average crystal grain size of the magnesium alloy is not less than 0.1 μm and not greater than 300 μm, dispersibility of the metal material and the like present in the crystal grains improves. In the stock shape, the average crystal grain size of the magnesium alloy is an average crystal grain size calculated by a measurement method according to the JIS standard (JIS G 0551). That is, the average crystal grain size of the magnesium alloy is an average crystal grain size determined by using a method of section including counting on a SEM at a known magnification the number of the crystal grains captured per millimeter of a test line having a known length or the number of intersections between a test line and crystal grain boundaries in a portion representing a test piece of the magnesium alloy.

Tensile Strength

The stock shape has tensile strength of not less than 200 MPa and not greater than 500 MPa. Since the tensile strength of the stock shape is as high as not less than 200 MPa and not greater than 500 MPa, the stock shape is very suitable for the application of forming a downhole tool component and a downhole tool for well drilling. The tensile strength of the stock shape is preferably not less than 250 MPa and not greater than 500 MPa, and more preferably not less than 300 MPa and not greater than 500 MPa.

The tensile strength of the stock shape can be measured by a known method in the related art. For example, the tensile strength of the stock shape can be measured in conformance with JISZ2241 (ISO6892) by using a test piece set forth in JIS Z2201 and applying strain until fracture occurs by tensile force.

Average Particle Size

The average particle size of the metal material and the degradation accelerator can be measured by capturing an image of a cut section of the magnesium alloy subjected to cutting and by calculating an average particle size of 30 microparticles. When the metal material and the degradation accelerator have a spherical shape, a diameter of the sphere is defined as a particle size. When the metal material and the degradation accelerator have a needle shape or a rod shape, a short diameter is defined as a particle size. When the metal material and the degradation accelerator are unshaped, an average diameter from the center of gravity is defined as a particle size.

Degradation Rate

The stock shape is configured to cause a downhole tool component or a downhole tool formed by using the stock shape to readily degrade. That is, the stock shape has a degradation rate in a 2% potassium chloride aqueous solution at 93° C. of not less than 20 mg/cm$^2$ and not greater than 20000 mg/cm$^2$ per day. Accordingly, the downhole tool or the downhole tool component can quickly degrade after well operation. The stock shape more preferably has the degradation rate in a 2% potassium chloride aqueous solution at 93° C. of not less than 500 mg/cm$^2$ and not greater than 2500 mg/cm$^2$ per day. Note that the stock shape is also degradable in any other chloride aqueous solution than the potassium chloride aqueous solution. Furthermore, the chloride aqueous solution preferably has pH controlled to be not greater than 11. At pH of 11, a passive film mainly including magnesium hydroxide is formed and the degradation rate decreases.

When the degradation rate of the stock shape is less than 20 mg/cm$^2$, the degradation rate in a well is low, and the stock shape remains as a component and accordingly may cause production impediment. Furthermore, when the degradation rate is greater than 20000 mg/cm$^2$, the degradation rate in a well excessively increases, and thus, degradation proceeds during well treatment such as hydraulic fracturing. Then, a hydraulic pressure cannot be kept, and a step defect may occur.

When the degradation rate at 93° C. is not less than 20 mg/cm$^2$ and not greater than 20000 mg/cm$^2$, well treatment can be carried out without problem, for example, at a temperature of 177° C., 163° C., 149° C., 121° C., 93° C., 80° C., or 66° C., and further at a temperature such as from 25° C. to 40° C., and degradation proceeds within a certain period after the well treatment, and a downhole tool component having degradability without necessity of milling of the component is established. Then, such a downhole tool component can be used in the above temperature range.

Note that a surface of a downhole tool component using the stock shape may be coated to prevent degradation of the downhole tool component during well treatment from proceeding and to provide corrosion resistance to the downhole tool component.

Furthermore, the stock shape preferably has a ratio of a degradation rate in a 2% potassium chloride aqueous solution at 93° C. and a degradation rate in a 7% potassium chloride aqueous solution at 93° C. of from 1.01:1 to 3.0:1. A 2% to 7% potassium chloride aqueous solution is generally used depending on an amount of clay during well drilling. Thus, the stock shape having a large difference in the degradation rate between a 2% potassium chloride aqueous solution and a 7% potassium chloride aqueous solution is difficult to use in well drilling. Therefore, the stock shape needs not to have a large difference between the degradation rate in a 2% potassium chloride aqueous solution at 93° C. and the degradation rate in a 7% potassium chloride aqueous solution at 93° C. The stock shape more preferably has a ratio of the degradation rate in a 2% potassium chloride aqueous solution at 93° C. and the degradation rate in a 7% potassium chloride aqueous solution at 93° C. of from 1.02:1 to 2.5:1.

Further, the stock shape is preferably degradable in a 1% potassium chloride aqueous solution. Various types of chloride solutions such as potassium chloride tend to be used in a reduced amount owing to environmental issues, and there is a demand for a downhole tool component degradable even in such a low-concentration chloride solution.

Furthermore, the stock shape is also preferably degradable in a lower-concentration chloride solution such as a not less than 0.01% and less than 0.5% chloride solution. A not less than 0.01% and less than 0.5% chloride aqueous solution may also be used in degradation of a downhole tool. The stock shape has the degradation rate in a 2% potassium chloride aqueous solution of not less than 20 mg/cm$^2$ and not greater than 20000 mg/cm$^2$ per day, and thus can also establish a practical degradation rate in a lower-concentration chloride solution such as a not less than 0.01% and less than 0.5% chloride solution.

The stock shape preferably has an outer diameter of not less than 30 mm and not greater than 200 mm, more preferably not less than 40 mm and not greater than 150 mm, even more preferably not less than 50 mm and not greater than 120 mm, and most preferably not less than 50 mm and not greater than 100 mm. The stock shape for a downhole tool component needs to have a size as large as an outer diameter of not less than 30 mm and not greater than 200 mm to form a downhole tool component. However, it is particularly difficult to form a stock shape having a large size and high strength. The stock shape according to an aspect of the present invention has high strength even with a size as large as an outer diameter of not less than 30 mm and not greater than 200 mm. Thus, a downhole tool component or a downhole tool having high strength can be formed by using this stock shape. Details of a shape of the stock shape and a method of producing the stock shape will be described below.

Downhole Tool Component

A downhole tool component according to an aspect of the present invention is formed with the stock shape for a downhole tool component according to an aspect of the present invention. Since the downhole tool component according to an aspect of the present invention is formed with the above stock shape according to an aspect of the present invention, the downhole tool component has strength high enough to withstand well drilling in high-temperature, high-pressure environments, and is also readily degradable in a chloride solution after well drilling. Note that at least a portion of the downhole tool component according to an aspect of the present invention may be formed with the stock shape according to an aspect of the present invention.

The downhole tool component refers to a component constituting at least a portion of a downhole tool. The "downhole tool" is generally a tool used to form a downhole (may be referred to as a "wellbore" or a "subterranean drilling bore") provided at the time of well drilling from above the ground (including above water) toward a production reservoir to acquire a hydrocarbon resource such as petroleum such as shale oil and natural gas such as shale gas, and serving as a flow path of the hydrocarbon resource to recover the hydrocarbon resource after completion of the well. A specific example of the downhole tool includes an isolation plug such as a frac plug, a bridge plug, a packer, and a cement retainer.

As a specific example of the downhole tool, a plug illustrated in a schematic view of the figure will be described. The plug that is the downhole tool includes the downhole tool component such as a mandrel 1, a center element 2, slips 3 and 3', backup rings 4 and 4', a load ring 5, cones 6 and 6', a shear sub 7, a bottom 8, and a ball 9. Furthermore, the plug may include a screw (not illustrated) for fixing the downhole tool component such as a side part. The case where the plug illustrated schematically in the figure is used will be described below.

The load ring 5 is configured to be slidable along an axial direction of the mandrel 1 on an outer circumferential surface of the mandrel 1 at an interval changeable between the load ring 5 and the mandrel 1. In addition, the load ring 5 is configured to be capable of directly or indirectly coming into contact with an end part along the axial direction of a combination of the diameter-expandable center element 2, the slips 3 and 3', the backup rings 4 and 4', the cones 6 and 6', the shear sub 7, and the bottom 8 to apply force in the axial direction of the mandrel 1 to the combination. The diameter-expandable center element 2 expands in diameter in a direction orthogonal to the axial direction of the mandrel 1 to come into contact with an inner wall of the downhole and closes (seals) a space between the plug and the downhole. Then, while perforation or fracturing in well treatment described below is performed, the diameter-expandable center element 2 can maintain the contact with the inner wall of the downhole and functions to maintain the sealing between the plug and the downhole. Furthermore, the force in the axial direction of the mandrel 1 is applied to the backup rings 4 and 4', and accordingly, the slips 3 and 3' slide on upper surfaces of slant surfaces of the backup rings 4 and 4'. As a result, the slips 3 and 3' move outward in a direction orthogonal to the axial direction of the mandrel 1 and come into contact with the inner wall of the downhole to fix the plug and the inner wall of the downhole.

The downhole tool component according to an aspect of the present invention preferably serves as the mandrel 1 or the side part as described above, and an example of the side part includes at least a portion of the slips 3 and 3', the backup rings 4 and 4', the load ring 5, the cones 6 and 6', the shear sub 7, and the bottom 8 as described above. Note that the side part such as the slips 3 and 3' can be formed with the stock shape according to an aspect of the present invention and other materials such as iron, and the side part such as the shear sub 7, and the load ring 5 can be formed with the stock shape according to an aspect of the present invention alone.

Furthermore, the downhole tool component according an aspect of the present invention may serve as a part configured to temporarily seal a flow path in a downhole tool (a sealing component), or a portion of the part, and such a part can have a ball shape, a screw shape, or a push pin shape. Specific examples of such a part include the ball 9 provided in a hollow part of the mandrel 1 illustrated in the figure. The ball 9 is provided to be movable along the axial direction of the mandrel 1 in the hollow part. The ball 9 comes into contact with or separates from a cavity present between the hollow part and the load ring 5, and accordingly, the ball 9 can temporarily seal or open the flow path in the plug.

The downhole tool component according to an aspect of the present invention preferably has an outer diameter of not less than 30 mm and not greater than 200 mm. The downhole tool component having an outer diameter of not less than 30 mm and not greater than 200 mm is suitable for constituting a downhole tool. The downhole tool component according to an aspect of the present invention can be obtained by subjecting the stock shape according to an aspect of the present invention to machining such as cutting and perforation.

Downhole Tool

A downhole tool according to an aspect of the present invention includes the above downhole tool component according to an aspect of the present invention. A specific example of the downhole tool according to an aspect of the present invention includes the above plug illustrated in the schematic view of the figure, but a structure of the plug is not limited to the structure illustrated in the schematic view of the figure. The downhole tool according to an aspect of the present invention is preferably a downhole tool selected from the group consisting of a frac plug and a bridge plug.

Since the downhole tool according to an aspect of the present invention includes the downhole tool component according to an aspect of the present invention, the downhole tool has strength high enough to withstand well drilling in high-temperature, high-pressure environments, and is also readily degradable in a chloride solution after well drilling.

Degradable Resin

The downhole tool according to an aspect of the present invention may further include a downhole tool component formed with a degradable resin. An example of the degradable resin forming the downhole tool component includes a degradable resin having biodegradability and being degradable by microorganisms in the formation in which fracturing fluid and the like are used, or a degradable resin having hydrolyzability and being degradable in a solvent such as fracturing fluid, particularly in water, and further as necessary in acid or alkali. Furthermore, the degradable resin may be a resin degradable by any other method, for example, by chemical degradation under a heating condition including a temperature not less than a specific temperature. Preferably, the degradable resin is a hydrolyzable resin being degradable in water at a temperature not less than a specific temperature. Note that the degradable resin also includes a resin having the intrinsic strength decreased by a decrease in a degree of polymerization or the like to become brittle, and as a result easily disintegrating by application of very small mechanical force to lose the shape (may be referred to as "disintegrability" hereinafter).

A downhole tool or a downhole tool component needs to be excellent in mechanical properties including impact resistance and also excellent in degradability in harsh and diverse environments such as deep subterranean high-temperature, high-pressure environments. Therefore, from this perspective, examples of the degradable resin include aliphatic polyester such as polylactic acid (PLA), polyglycolic acid (PGA), and poly-ε-caprolactone (PCL), and polyvinyl alcohol (partially saponified polyvinyl alcohol and the like having a degree of saponification of 80 to 95 mol %), but the degradable resin is more preferably aliphatic polyester. Furthermore, a combination of components forming aromatic polyester such as terephthalic acid can also be used as long as properties as a degradable resin are kept. The degradable resin can be used alone or a combination obtained by blending two or more types of the degradable resins can also be used.

From the perspective of excellent mechanical properties including impact resistance and excellent degradability that a downhole tool or a downhole tool component need to have, the aliphatic polyester is most preferably at least one selected from the group consisting of PGA, PLA, and a glycolic acid-lactic acid copolymer (PGLA), and PGA is even more preferable. That is, the degradable resin is most preferably PGA. Note that the PGA encompasses a homopolymer of glycolic acid, and also a copolymer containing not less than 50 mass %, preferably not less than 75 mass %, more preferably not less than 85 mass %, even more preferably not less than 90 mass %, particularly preferably not less than 95 mass %, most preferably not less than 99 mass %, and especially preferably not less than 99.5 mass % of glycolic acid repeating units. Furthermore, the PLA encompasses a homopolymer of L-lactic acid or D-lactic acid, and also a copolymer containing not less than 50 mass %, preferably not less than 75 mass %, more preferably not less than 85 mass %, and even more preferably not less than 90 mass % of L-lactic acid or D-lactic acid repeating units. A copolymer having a ratio (mass ratio) of glycolic acid repeating units to lactic acid repeating units of from 99:1 to 1:99, preferably from 90:10 to 10:90, and more preferably from 80:20 to 20:80 can be used as the PGLA.

A content of the degradable resin in the downhole tool component can be determined as appropriate in consideration of impact resistance and tensile characteristics that the downhole tool or the downhole tool component need to have and in consideration of ease of removal performed as necessary after well drilling. However, the content is typically from 70 to 97 mass %, preferably from 73 to 96 mass %, more preferably from 76 to 95.5 mass %, and even more preferably from 79 to 95 mass %, with respect to 100 mass % of a total of the degradable resin and other components in the downhole tool component.

Furthermore, the downhole tool component that the downhole tool according to an aspect of the present invention can include may be formed with a degradable resin composition including the above degradable resin, and the degradable resin composition may further include a reinforcing agent such as an organic fiber reinforcing agent, an inorganic fiber reinforcing agent, or a particulate-form or powder-form reinforcing agent, a chain extender, a stabilizer, a degradation accelerator, a degradation inhibitor, and the like.

Examples of the organic fiber reinforcing material include organic fiber having a high melting point and formed with a polyamide resin, a polyester resin, an acrylic resin, a fluororesin, and the like. However, from the perspective of mechanical strength, impact resistance, and degradability of the degradable resin composition forming the downhole tool or the component thereof, a preferable example of the organic fiber reinforcing material includes an organic fiber reinforcing material categorized as so-called high-performance/high-function fiber or super fiber having high strength, impact resistance, heat resistance, and the like. More specifically, examples of the organic fiber reinforcing material include aramid fiber (all types of aromatic polyaramid fiber) such as Kevlar (trade mark), Towaron (trade mark), Technora (trade mark), and Nomex (trade mark); polyparaphenylene benzobisoxazole fiber such as Zylon (trade mark); polyarylate fiber (polyester) such as Vectran (trade mark); tetrafluoroethylene fiber such as Toyoflon (trade mark) and Teflon (trade mark); and ultra high molecular weight polyethylene fiber such as Dyneema (trade mark). Aramid fiber or polyparaphenylene benzobisoxazole fiber are particularly preferable.

Examples of the inorganic fiber reinforcing material include inorganic fiber such as glass fiber, carbon fiber, asbestos fiber, silica fiber, alumina fiber, zirconia fiber, boron nitride fiber, silicon nitride fiber, boron fiber, and potassium titanate fiber; and alloy fiber or metal fiber such as stainless steel, aluminum, titanium, steel, and brass.

Examples of the particulate-form or powder-form reinforcing material that can be used include mica, silica, talc, alumina, kaolin, calcium sulfate, calcium carbonate, titanium oxide, ferrite, clay, glass powder (milled fiber or the like), zinc oxide, nickel carbonate, iron oxide, quartz powder, magnesium carbonate, and barium sulfate.

As the chain extender, a compound used in the related art as a chain extender of a degradable resin can be used. Examples of the chain extender include an oxazoline compound, an isocyanate compound, a carboxyimide compound, a carboxyimide modified isocyanate compound, a fatty acid bisamide compound, an alkyl substituted fatty acid monoamide compound, a 1- to 3-functional glycidyl modified compound having a triazine framework, an epoxy compound, an acid anhydride, an oxazine compound, and a ketene compounds. One type or a combination of two or more types thereof may be used.

Degradable Rubber

The downhole tool according to an aspect of the present invention may further include a downhole tool component formed with a degradable rubber.

Examples of the downhole tool component formed with the degradable rubber can include a rubber component for a downhole tool such as a seal component such as an isolation component in the above isolation plug that is the downhole tool, and a ball seat used in a frac sleeve (sleeve system) or the like.

The degradable rubber forming the downhole tool component preferably has a decrease rate of a compressive elasticity modulus obtained after immersion of the degradable rubber for 24 hours in 150° C. water with respect to a compressive elasticity modulus obtained before the immersion of not less than 5%. The degradable rubber having strength thus decreasing also has surface hardness that decreases in the course of degradation. For example, an ester urethane rubber of hardness A82 immersed in 121° C. deionized water (DI water) obtains hardness A25 after 13 hours and hardness A0 after 48 hours, and becomes gel after 72 hours. Such a hardness decrease associated with degradation is dependent on temperature. For example, time until hardness reaches 0 is 350 hours at 93° C., 270 hours at 99° C., 135 hours at 104° C., 110 hours at 110° C., 36 hours at 116° C., 26 hours at 121° C., 7 hours at 132° C., and the like.

Such degradation behavior of the degradable rubber can be adjusted as appropriate by changing types and quantities and the presence or absence of a base polymer, an additive, and the like. Further increased hardness of the degradable rubber enables well treatment in a relatively high temperature region, and also enables adjustment to accelerate degradation. Furthermore, an acidic substance or an acid-producing substance can also be added to the degradable rubber as necessary to increase degradability of the degradable rubber.

The degradable rubber having the above properties is not particularly limited, and can be one selected from rubber materials used in a known downhole tool. A preferable example of the degradable rubber includes a degradable rubber containing at least one selected from the group consisting of a natural rubber, polyisoprene, an ethylene propylene rubber, a butyl rubber, a styrene rubber (a styrene-butadiene rubber and the like), an acrylic rubber, an aliphatic polyester rubber, a chloroprene rubber, and a urethane rubber. Furthermore, from the perspective of degradability and disintegrability, a preferable example of the degradable rubber includes a degradable rubber containing a rubber having a hydrolyzable functional group (for example, a urethane group, an ester group, an amide group, a carboxyl group, a hydroxyl group, a silyl group, an acid anhydride, and an acid halide).

From the perspective of degradability and disintegrability readily controllable by adjusting a structure, hardness, and a degree of crosslinking of the degradable rubber or by selecting other blended agents, a particularly preferable example of the degradable rubber includes a urethane rubber.

Urethane Rubber

The urethane rubber (may be referred to as a "urethane elastomer") particularly preferably used as the degradable rubber forming the downhole tool component is a rubber material having a urethane bond (—NH—CO—O—) in molecules, and is normally obtained by condensation of an isocyanate compound and a compound having a hydroxyl group. The compound having a hydroxyl group is broadly classified into a polyester-type urethane rubber having an ester bond in a main chain thereof (may be referred to as an "ester-type urethane rubber" hereinafter) and a polyether-type urethane rubber having an ether bond in a main chain thereof (may be referred to as an "ether-type urethane rubber" hereinafter). From the perspective of degradability and disintegrability readily controllable, the ester-type urethane rubber is particularly preferable.

The urethane rubber is an elastic body having both elasticity (flexibility) of a synthetic rubber and rigidity (hardness) of plastic. The urethane rubber is generally known to be excellent in abrasion resistance, chemical resistance, and oil resistance, and known to exhibit high mechanical strength, high load tolerance, and high elasticity with high energy absorbency. The urethane rubber can be classified depending on differences in a forming method into i) a kneaded (millable) type urethane rubber that can be formed by the same processing method as a processing method of a general rubber; ii) a thermoplastic type urethane rubber that can be formed by the same processing method as a processing method of a thermoplastic resin, and iii) a cast type urethane rubber that can be formed by a processing method using a liquid raw material to perform heat curing. Any of the types of urethane rubbers can be used as the urethane rubber forming the rubber component for a downhole tool according to an aspect of the present invention.

Specific examples of the urethane rubber include those prepared as follows:

(1) A rubber component for a downhole tool having a 150° C. 24-hour compressive stress decrease rate of 100% and a 150° C. volume increase rate of 2% can be prepared by using an ester-type thermoplastic urethane rubber (crosslinked type) of hardness A95. The rubber component has a 150° C. 72-hour mass loss rate of 58%, a mass loss rate of −1% (a volume increase) after immersion for 1 hour in 150° C. water, a mass loss rate of −2% (a volume increase) after immersion for 3 hours, and a mass loss rate of 13% after immersion for 24 hours.

(2) A rubber component for a downhole tool having a 150° C. 24-hour compressive stress decrease rate of 83% and a 150° C. volume increase rate of 1% can be prepared by using a lactone-based ester-type thermoplastic urethane rubber (uncrosslinked type) of hardness D74. The rubber component has a 150° C. 72-hour mass loss rate of 43%, a mass loss rate of −1% (a volume increase) after immersion for 1 hour in 150° C. water, a mass loss rate of −2% (a volume increase) after immersion for 3 hours, a mass loss rate of 2% after immersion for 24 hours, and a mass loss rate of 33% after immersion for 48 hours.

(3) A rubber component for a downhole tool having a 150° C. 24-hour compressive stress decrease rate of 100% and a 150° C. volume increase rate of 5% can be prepared by using an ester-type thermoplastic urethane rubber (uncrosslinked type) of hardness A70.

(4) A rubber component for a downhole tool having a 150° C. 24-hour compressive stress decrease rate of 41% and a 150° C. volume increase rate of 4.9% can be prepared by using an ester-type thermoplastic urethane rubber (crosslinked type) of hardness A85. When a compressive stress decrease rate at 121° C. of the rubber component is measured, the compressive stress decrease rate is 1% after immersion for 24 hours, 1% after immersion for 48 hours, and 100% after immersion for 72 hours. A test piece having subjected to immersion for 72 hours is found to have cracked after the compressive stress test, and not to recover the shape. Further, the rubber component has a 66° C. tensile fracture strain of 414%, a 66° C. compressive stress of 41 MPa, and a 66° C. compressive fracture strain of not less than 95%. Further, the rubber component is stable in a dry environment, and has a 23° C. compressive stress decrease rate of 0%, a compressive stress ratio at 66° C. of 20 folds, and a 150° C. 72-hour mass loss rate of 72%.

(5) A rubber component for a downhole tool having a 150° C. 24-hour compressive stress decrease rate of 100% can be prepared by using an ester-type thermosetting urethane rubber of hardness A90 (with Stabaxol (trade name) added as a hydrolysis inhibitor). When a decrease rate of a 50% strain compressive stress obtained after immersion for specific time in 93° C. water with respect to a 50% strain compressive stress obtained before the immersion (may be referred to as a "compressive stress decrease rate at 93° C." hereinafter) of the rubber component is measured, the decrease rate is 28% after immersion for 24 hours, 44% after immersion for 72 hours, 50% after immersion for 168 hours, and 100% after immersion for 336 hours. A test piece having subjected to immersion for 336 hours is found to have cracked after the compressive stress test, and not to recover the shape. Note that the rubber component has a 150° C. volume increase rate decreased, and it is assumed that the rubber has degraded during the immersion in the 150° C. water and is distributed in the water.

(6) A rubber component for a downhole tool having a 150° C. 24-hour compressive stress decrease rate of 100% can be prepared by using an ester-type thermosetting urethane rubber of hardness A90 (without a hydrolysis inhibitor added). The rubber component has a 66° C. tensile fracture strain of 206%, a 66° C. compressive stress of 22 MPa, and a 66° C. compressive fracture strain of not less than 95%. Further, the rubber component is stable in a dry environment, and has a 23° C. compressive stress decrease rate of 0%, a 66° C. compressive stress ratio of 41 folds, and a 150° C. 72-hour mass loss rate of 100%. Further, the rubber component has a compressive stress decrease rate at 93° C. of 20% after immersion for 24 hours, 40% after immersion for 72 hours, 100% after immersion for 168 hours, and 100% after immersion for 336 hours. A test piece having subjected to immersion for 168 hours and 336 hours is found to have cracked and collapsed during the compressive stress test. Further, a decrease rate of a 50% strain compressive stress obtained after immersion for specific time in 80° C. water with respect to a 50% strain compressive stress obtained before the immersion (may be referred to as a "compressive stress decrease rate at 80° C." hereinafter) of the rubber component is 9% after immersion for 24 hours, 11% after immersion for 72 hours, 23% after immersion for 168 hours, and 49% after immersion for 336 hours. Furthermore, when a decrease rate of a 50% strain compressive stress obtained after immersion for specific time in 66° C. water with respect to a 50% strain compressive stress obtained before the immersion (may be referred to as a "compressive stress decrease rate at 66° C." hereinafter) of the rubber component is measured, the decrease rate is not greater than 5% after immersion for 24 hours. Furthermore, the rubber component has a 150° C. volume increase rate decreased.

(7) A rubber component for a downhole tool having a 150° C. 24-hour compressive stress decrease rate of 100% can be prepared by using an ester-type thermosetting urethane rubber of hardness A82 (without a hydrolysis inhibitor added). The rubber component has a 66° C. tensile fracture strain of 289%, a 66° C. compressive stress of 17 MPa, and a 66° C. compressive fracture strain of not less than 95%. Further, the rubber component is stable in a dry environment, and has a 23° C. compressive stress decrease rate of 0%, a compressive stress ratio at 66° C. of 23 folds, and a 150° C. 72-hour mass loss rate of 100%. Further, the rubber component has a compressive stress decrease rate at 93° C. of 8% after immersion for 24 hours, 27% after immersion for 72 hours, 100% after immersion for 168 hours, and 100% after immersion for 336 hours. A test piece having subjected to immersion for 168 hours and 336 hours is found to have cracked and collapsed during the compressive stress test. Note that the rubber component has a compressive stress decrease rate at 66° C. of not greater than 5% after immersion for 24 hours. Furthermore, the rubber component has a 150° C. volume increase rate decreased.

Furthermore, the downhole tool component according to an aspect of the present invention may include, in addition to the above degradable rubber, a rubber material composition containing or blended with various additives such as other types of rubber materials or resin materials, a reinforcing material, a stabilizer, and a degradation accelerator or a degradation inhibitor, as other blended components within the range where the additives do not hinder the objective of the present invention.

The downhole tool component according to an aspect of the present invention can be used in a temperature region having the wide range, and the type of the degradable rubber can also be changed as appropriate in the temperature region.

Well Treatment Method

A well treatment method according to an aspect of the present invention uses any of the above downhole tools according to an aspect of the present invention. The well treatment method according to an aspect of the present invention can be the same as a known well treatment method except that the downhole tool according to an aspect of the present invention is used in treatment such as well drilling.

The well treatment method according to an aspect of the present invention is performed to form a well including a porous and permeable subterranean formation to excavate and produce a hydrocarbon resource such as petroleum or natural gas through the well.

As energy consumption increases, a deep well is increasingly formed, and there is recorded drilling to the depth of greater than 9000 m in the world and there is a deep well having a depth of greater than 6000 m in Japan. In a well continuously excavated, a production reservoir is stimulated to continuously excavate a hydrocarbon resource efficiently from a subterranean formation having permeability decreasing over time and from a subterranean formation intrinsically having insufficient permeability. Acid treatment and hydraulic fracturing are known as a stimulation method.

The acid treatment is a method including injecting acid such as hydrochloric acid and hydrofluoric acid into a production reservoir and dissolving a reaction component of bedrock (such as carbonate, clay mineral, and silicate) to increase permeability of the production reservoir. However, various problems associated with use of strong acid have been mentioned, and various countermeasures and a cost increase have also been mentioned. Thus, the hydraulic fracturing (may be referred to as "fracturing") including forming a perforation or a fracture to form a pore in a production reservoir by using fluid pressure has been focused on.

The hydraulic fracturing is a method including generating a perforation or a fracture in a production reservoir by fluid pressure such as hydraulic pressure (may simply be referred to as "hydraulic pressure" hereinafter). Generally, the hydraulic fracturing is a stimulation method of a production reservoir including: drilling a vertical hole and subsequently bending the vertical hole to drill a horizontal hole in a subterranean formation located several thousand meters underground; thereafter, feeding fluid such as fracturing fluid into these wellbores (downholes) at high pressure; generating a fracture and the like by hydraulic pressure in a deep subterranean production reservoir (a layer producing a hydrocarbon resource such as petroleum or natural gas); and extracting and recovering the hydrocarbon resource through the fracture and the like. The hydraulic fracturing has also been focused on for efficacy in development of an unconventional resource such as so-called shale oil (oil maturing in shale) and shale gas.

The well treatment method according to an aspect of the present invention can be the above hydraulic fracturing. In the hydraulic fracturing, a fracture or a perforation is generated by hydraulic pressure in a production reservoir of a deep subterranean formation (a layer producing a hydrocarbon resource such as petroleum such as shale oil or natural gas such as shale gas) by using fluid fed in at high pressure. In a method of generating a fracture or a perforation by hydraulic pressure, typically, a downhole drilled in a subterranean formation located several thousand meters underground is subjected to isolation sequentially from a tip of the downhole to partially close a specific section of the downhole, and fluid is fed in at high pressure into the closed section to generate a fracture or a perforation in a production reservoir. Then, the next specific section (typically, a section nearer to the ground surface than the preceding section, that is, a section on the ground surface side) is closed to generate a fracture or a perforation. Subsequently, this step is repeated until completion of necessary isolation and formation of a fracture or a perforation.

The above downhole plug can be used to close a downhole and to generate a fracture. Sealing of a downhole by the downhole plug for well drilling is performed as follows. That is, the mandrel is moved in the axial direction of the mandrel, and accordingly, as a gap between a ring or an annular member and an anti-rotation feature reduces, the slip comes into contact with a slant surface of a conical member and proceeds along the conical member, and thus, the slip expands radially outward, and comes into contact with an inner wall of a downhole to be fixed in the downhole; and a malleable element deforms by diametric expansion, and comes into contact with the inner wall of the downhole to seal the downhole. The mandrel includes a hollow part in the axial direction, and a ball or the like is set in the hollow part, and accordingly, the downhole can be sealed.

Downhole plugs used in well drilling are disposed sequentially in a well until the well is completed, but the downhole plugs need to be removed when production of petroleum such as shale oil or natural gas such as shale gas starts. A typical plug not designed to be retrievable after use and release of closure is destroyed or broken into small fragments by milling, drilling out, or another method to be removed, but substantial costs and time have been necessary for milling, drilling out, and the like. Furthermore, there is also a plug specially designed to be retrievable after use, but since the plugs are placed in deep subterranean, substantial costs and time have been necessary for retrieving all of the plugs.

Since the well treatment method according to an aspect of the present invention uses the downhole tool according to an aspect of the present invention in well drilling, the downhole tool component according to an aspect of the present invention constituting the downhole tool to be removed after well drilling readily degrades in a chloride solution. Therefore, there is no need to retrieve the downhole tool with costs and time. Time until the downhole tool is removed after the downhole tool is placed in a well is approximately from 1 day to 1 month, and approximately from 3 days to 3 weeks, and in particular, approximately from 5 days to 2 weeks.

The well treatment method according to an aspect of the present invention preferably includes a step of degrading the downhole tool by pumping a chloride solution into a downhole after well drilling. At the above step, the chloride solution pumped into the downhole is not particularly limited as long as the chloride solution degrades the magnesium alloy forming the downhole tool component, but is preferably a potassium chloride aqueous solution. Furthermore, at the above step, the potassium chloride aqueous solution pumped into the downhole is more preferably a 2% to 7% potassium chloride aqueous solution. Further, the potassium chloride aqueous solution is particularly preferably warmed to 93° C. A 0.01% to 0.5% potassium chloride aqueous solution can also be used instead of the above potassium chloride aqueous solution. Note that in the well treatment method according to an aspect of the present invention, the chloride solution used according to a state of clay during well drilling may be used as the chloride solution for degrading the downhole tool.

According to the well treatment method according to an aspect of the present invention, since the downhole tool used has high strength and is also readily degradable, an operation such as closure, perforation, and fracturing can be performed reliably, and also the downhole tool can be removed readily and a flow path can be secured readily under diverse well environment conditions to contribute to a cost reduction and shortening of steps.

Method of Producing Stock Shape for Downhole Tool Component

The stock shape for a downhole tool component according to an aspect of the present invention can be obtained by processing a cast product obtained by casting the above magnesium alloy raw material. Examples of a method of processing a cast product include extrusion processing, rolling processing, and forging processing. These types of processing may be hot processing or cold processing.

Casting

In the method of producing a stock shape for a downhole tool component according to an aspect of the present invention, first, a raw material including not less than 70 wt. % and not greater than 95 wt. % of magnesium, not less than 0 wt. % and less than 0.3 wt. % of a rare earth metal, a metal material other than the magnesium and the rare earth metal, and not less than 0.1 wt. % and not greater than 20 wt. % of a degradation accelerator is cast, and a thermal refining step may further be performed as necessary. Accordingly, the metal material includes a portion having crystallized out during casting and having undergone solid solution, and a portion remaining without undergoing solid solution. An average crystal grain size of the magnesium in the cast product can be controlled by casting conditions.

The magnesium alloy material can be gravity cast, die cast, low-pressure cast, or high-pressure cast. The high-pressure casting may be used to further reduce an average particle size of the metal material in the magnesium phase in the magnesium alloy material. As for the casting conditions, the magnesium alloy material melted in an argon gas, chlorine gas, sulfur hexafluoride gas, or nitrogen gas atmosphere may be poured into a desired die, and thereafter, may be cooled at a temperature of not lower than 0° C. and not higher than 100° C., and at a cooling rate of not less than 20° C./second with application of pressure of not less than 5 MPa and not greater than 100 MPa. A temperature at which the magnesium alloy material is melted may be not lower than 650° C. and not higher than 850° C., or may be not lower than 700° C. and not higher than 800° C.

Furthermore, crystal grain refinement treatment may also be performed on the cast product. The average particle size of the metal material in the magnesium phase can be further reduced by performing the crystal grain refinement treatment on the cast product. The crystal grain refinement treatment performed during the casting may be known crystal grain refinement treatment in the related art, and examples of the crystal grain refinement treatment include a method including adding a crystal refining material such as cane sugar, hexachloroethane, and boron and then pouring the melted magnesium alloy material into a die, and a method including rapid solidification by a twin roll process.

Further, a magnesium alloy in which any of the rare earth metal, the metal material, and the degradation accelerator is distributed in advance or in which all of the rare earth metal, the metal material, and the degradation accelerator are distributed in advance may be melted in the magnesium phase and cast. Accordingly, a stock shape for a downhole tool component in which the rare earth metal, the metal material, and the degradation accelerator are more uniformly distributed can be obtained. When the stock shape for a downhole tool component in which the rare earth metal, the metal material, and the degradation accelerator are more uniformly distributed is used, a downhole tool and a downhole tool component uniformly exhibiting high strength and given sufficient strength and being also rapidly and reliably degradable at a uniform degradation rate can be established.

In the casting step, the casting is preferably performed to obtain a cast product (cast billet) measuring not less than 6 inches and not greater than 12 inches. Accordingly, the stock shape for a downhole tool component having high strength can be obtained.

Extrusion Processing

An extruded product may be obtained by further extruding the cast product having been cast as described above. Accordingly, a stock shape for a downhole tool component having tensile strength of not less than 200 MPa and not greater than 500 MPa can be obtained. The extrusion processing is preferably hot extrusion, cold extrusion, or warm extrusion, and is more preferably hot extrusion.

An extrusion temperature is preferably not lower than 200° C. and not higher than 550° C., and may be not lower than 300° C. and not higher than 500° C., or may be not lower than 350° C. and not higher than 450° C. An extrusion ratio may be from 1.5 to 300.

An extruded product having an outer diameter of not less than 30 mm and not greater than 200 mm is preferably obtained by performing such extrusion processing. Accordingly, the stock shape for a downhole tool component having high strength can be obtained.

Rolling Processing

A rolled product may be obtained by further rolling the cast product having been cast as described above. Accordingly, a stock shape for a downhole tool component having tensile strength of not less than 200 MPa and not greater than 500 MPa can be obtained. The rolling processing is preferably hot rolling, cold rolling, or warm rolling, and is more preferably hot rolling.

A rolling temperature is preferably not lower than 200° C. and not higher than 550° C., and may be not lower than 300° C. and not higher than 500° C., or may be not lower than 350° C. and not higher than 450° C.

A rolled product having an outer diameter of not less than 30 mm and not greater than 200 mm is preferably obtained by performing such rolling processing. Accordingly, the stock shape for a downhole tool component having high strength can be obtained.

Forging Processing

A forged product may be obtained by further forging the cast product having been cast as described above. For example, the cast product is pressure forged. Accordingly, a stock shape for a downhole tool component that is a forged product having tensile strength of not less than 200 MPa and not greater than 500 MPa is obtained. The forging processing is preferably hot forging, cold forging, or cast forging, and is more preferably hot forging.

A forging temperature is preferably not lower than 200° C. and not higher than 550° C., more preferably not lower than 300° C. and not higher than 500° C., and even more preferably not lower than 250° C. and not higher than 350° C. A draft may be not less than 25% and not greater than 90%.

A forged product having an outer diameter of not less than 30 mm and not greater than 200 mm is preferably obtained by performing such forging processing. Accordingly, the stock shape for a downhole tool component having high strength can be obtained.

The extruded product, the rolled product, the forged product, or the like obtained by the above processing may be further heat treated to cause the metal material in the crystal grains to diffuse. A temperature in the heat treatment is preferably not lower than 300° C. and not higher than 600° C., and may be not lower than 350° C. and not higher than 450° C. Note that heat treatment time is not particularly limited, but the heat treatment may be performed for, for example, not less than 3 minutes and not greater than 24 hours.

A shape of the stock shape for a downhole tool component obtained by the extrusion processing, the rolling processing, the forging processing, or the like is not particularly limited but may be, for example, a rod shape, a hollow shape or a plate shape. A downhole tool or a downhole tool component having a ball shape, or a downhole tool or a downhole tool component including a rod-shaped body, a hollow body, or a plate-shaped body having a heteromorphic cross section (for example, a rod-shaped body or a hollow body including portions having different outer diameters and/or inner diameters in a length direction) can be produced by subjecting the obtained stock shape to machining such as cutting and perforation as necessary. Further, a downhole tool or a downhole tool component may be produced by combining molded products obtained by these production methods by using a known method.

Additional Matters

The stock shape for a downhole tool component according to an aspect of the present invention preferably has the average particle size of the metal material and the degradation accelerator of not greater than 100 μm.

The stock shape for a downhole tool component according to an aspect of the present invention preferably has tensile strength of not less than 300 MPa and not greater than 500 MPa.

In the stock shape for a downhole tool component according to an aspect of the present invention, the degradation accelerator is preferably at least one metal selected from the group consisting of iron, nickel, copper, cobalt, zinc, cadmium, calcium, and silver.

The stock shape for a downhole tool component according to an aspect of the present invention preferably has a ratio of the degradation rate in a 2% potassium chloride aqueous solution at 93° C. and the degradation rate in a 7% potassium chloride aqueous solution at 93° C. of 1.01:1 to 3.0:1.

In the stock shape for a downhole tool component according to an aspect of the present invention, the metal material is preferably at least one metal selected from the group consisting of aluminum and zirconium.

The stock shape for a downhole tool component according to an aspect of the present invention preferably includes aluminum as the metal material and includes zinc as the degradation accelerator. A content of the aluminum is preferably not less than 3 wt. % and not greater than 15 wt. %, and a content of the zinc is preferably not less than 0.1 wt. % and not greater than 5 wt. %.

The stock shape for a downhole tool component according to an aspect of the present invention preferably has an outer diameter of not less than 30 mm and not greater than 200 mm.

The downhole tool component according to an aspect of the present invention preferably serves as a mandrel or a side part.

In the downhole tool component according to an aspect of the present invention, the side part preferably serves as at least a portion of a slip, a shear sub, a load ring, a cone, or a side part fixing screw.

The downhole tool component according an aspect of the present invention preferably serves as a sealing component configured to temporarily seal a flow path in a downhole tool or a portion of the sealing component.

In the downhole tool component according to an aspect of the present invention, the sealing component preferably has a ball shape, a screw shape, or a push pin shape.

The downhole tool according to an aspect of the present invention preferably serves as a frac plug or a bridge plug.

The downhole tool according to an aspect of the present invention preferably further includes a downhole tool component formed with a degradable resin.

In the downhole tool according to an aspect of the present invention, the degradable resin is preferably polyester.

In the downhole tool according to an aspect of the present invention, the polyester is preferably polyglycolic acid.

The downhole tool according to an aspect of the present invention preferably further includes a downhole tool component formed with a degradable rubber.

The stock shape for a downhole tool component according to an aspect of the present invention preferably includes at least one selected from the group consisting of iron, nickel, and copper as the degradation accelerator.

The stock shape for a downhole tool component according to an aspect of the present invention preferably includes not less than 0.01 wt. % and not greater than 20 wt. % of at least one selected from the group consisting of iron, nickel, copper, and cobalt as the metal material.

An aspect of the present invention is not limited to each embodiment described above, and various modifications can be made within the scope of the claims. Embodiments obtained by appropriately combining the technical means disclosed in the different embodiments also fall within the technical scope of an aspect of the present invention.

EXAMPLES

Example 1

A stock shape having an outer diameter of 50 mm and an inner diameter of 20 mm was obtained as described in the embodiments from a magnesium alloy material including 9 wt. % of aluminum and 0.2% of manganese as a metal material, and 0.6 wt. % of zinc, 2 wt. % of calcium, and from 0.2 wt. % to 0.5 wt. % of nickel as a degradation accelerator.

The obtained stock shape was observed by SEM, and an average crystal grain size of the magnesium alloy was measured by visually measuring the observed crystal grain size. As a result, the average crystal grain size of the stock shape of Example 1 was from 20 to 40 μm.

Furthermore, tensile strength of the obtained stock shape was measured in conformance with JISZ2241 (ISO6892) by using a test piece set forth in JIS Z2201 and applying strain until fracture occurs by tensile force. As a result, the tensile strength of the stock shape of Example 1 was 310 MPa.

Further, a degradation rate of the obtained stock shape was measured as follows. That is, the stock shape including a square surface measuring 10 mm on a side was immersed in 1 L of a 2% KCl aqueous solution at 93° C., and the weight (mg) of the shape material degraded in 3 hours was measured. As a result, the degradation rate in a 2% KCl solution at 93° C. of the stock shape of Example 1 was 1120 $mg/cm^2$ per day. Similarly, a degradation rate in a 7% KCl solution at 93° C. of the stock shape of Example 1 was 2142 $mg/cm^2$ per day. Furthermore, a degradation rate in a 0.5% KCl aqueous solution at 93° C. of the stock shape of Example 1 was 829 $mg/cm^2$ per day, and a degradation rate in a 0.1% KCl aqueous solution at 93° C. of the stock shape of Example 1 was 287 $mg/cm^2$ per day. Note that a degradation rate in a 2% KCl solution at 66° C. of the stock shape of Example 1 was 834 $mg/cm^2$ per day.

Furthermore, when a square PGA stock shape measuring approximately 15 mm on a side and a square Mg stock shape measuring 10 mm on a side were immersed in a 0.05% KCl aqueous solution at 93° C. and a degradation rate of the Mg stock shape was measured, the degradation rate of the Mg stock shape was 220 $mg/cm^2$ per day. A degradation rate obtained when the PGA stock shape and the Mg stock shape were immersed in ion-exchanged water was 107 $mg/cm^2$.

Example 2

A stock shape having an outer diameter of 59 mm was obtained in the same manner as in Example 1 from a magnesium alloy material including 9 wt. % of aluminum and 0.2% of manganese as a metal material, and 0.6 wt. % of zinc, 2 wt. % of calcium, and from 0.5 wt. % to 1.0 wt. % of nickel as a degradation accelerator.

When an average crystal grain size of the obtained stock shape was measured in the same manner as in Example 1, the average crystal grain size was from 20 to 50 μm.

When tensile strength and a degradation rate of the stock shape of Example 2 were measured in the same manner as in Example 1, the tensile strength was 310 MPa, the degradation rate in a 1% KCl solution at 93° C. was 2459 $mg/cm^2$ per day, the degradation rate in a 2% KCl solution at 93° C. was 2422 $mg/cm^2$ per day, and the degradation rate in a 7% KCl solution at 93° C. was 2660 $mg/cm^2$ per day.

Example 3

A stock shape having an outer diameter of 10 mm was obtained in the same manner as in Example 1 from a magnesium alloy material including 9 wt. % of aluminum, 0.2% wt. % of manganese, and 0.02 wt. % of silicon as a metal material, and 0.5 wt. % of zinc and 0.5 wt. % of nickel as a degradation accelerator.

When an average crystal grain size of the obtained stock shape was measured in the same manner as in Example 1, the average crystal grain size was from 10 to 30 μm.

When tensile strength and a degradation rate of the stock shape of Example 3 were measured in the same manner as in Example 1, the tensile strength was 322 MPa, the degradation rate in a 2% KCl solution at 93° C. was 1441 mg/cm$^2$ per day, and the degradation rate in a 7% KCl solution at 93° C. was 1968 mg/cm$^2$ per day.

Furthermore, when a square PGA stock shape measuring approximately 15 mm on a side and a square Mg stock shape measuring 10 mm on a side were immersed in a 2% KCl aqueous solution at 93° C. and a degradation rate of the Mg stock shape was measured, the degradation rate of the Mg stock shape was 1549 mg/cm$^2$ per day. A degradation rate obtained when the PGA stock shape and the Mg stock shape were immersed in a 0.05% KCl solution was 340 mg/cm$^2$, and a degradation rate obtained when the PGA stock shape and the Mg stock shape were immersed in ion-exchanged water was 138 mg/cm$^2$.

Example 4

A stock shape having an outer diameter of 10 mm was obtained in the same manner as in Example 1 from a magnesium alloy material including 0.5 wt. % of zirconium as a metal material, and 5 wt. % of zinc and 1 wt. % of nickel as a degradation accelerator.

When an average crystal grain size of the obtained stock shape was measured in the same manner as in Example 1, the average crystal grain size was from 10 to 50 μm.

When tensile strength and a degradation rate of the stock shape of Example 4 were measured in the same manner as in Example 1, the tensile strength was 303 MPa, the degradation rate in a 1% KCl solution at 93° C. was 305 mg/cm$^2$ per day, the degradation rate in a 2% KCl solution at 93° C. was 422 mg/cm$^2$ per day, and the degradation rate in a 7% KCl solution at 93° C. was 714 mg/cm$^2$ per day.

Example 5

A stock shape having an outer diameter of 10 mm was obtained in the same manner as in Example 1 from a magnesium alloy material including 9 wt. % of aluminum as a metal material, and 0.5 wt. % of zinc and 2.6 wt. % of copper as a degradation accelerator.

When an average crystal grain size of the obtained stock shape was measured in the same manner as in Example 1, the average crystal grain size was from 10 to 50 μm.

When tensile strength and a degradation rate of the stock shape of Example 5 were measured in the same manner as in Example 1, the tensile strength was 329 MPa, the degradation rate in a 2% KCl solution at 93° C. was 95 mg/cm$^2$ per day, and the degradation rate in a 7% KCl solution at 93° C. was 98 mg/cm$^2$ per day.

Example 6

A stock shape having an outer diameter of 10 mm was obtained in the same manner as in Example 1 from a magnesium alloy material including 9 wt. % of aluminum as a metal material, and 0.5 wt. % of zinc, 2.6 wt. % of copper, and 0.5 wt. % of nickel as a degradation accelerator.

When an average crystal grain size of the obtained stock shape was measured in the same manner as in Example 1, the average crystal grain size was from 10 to 50 μm.

When tensile strength and a degradation rate of the stock shape of Example 6 were measured in the same manner as in Example 1, the tensile strength was 350 MPa, the degradation rate in a 2% KCl solution at 93° C. was 1050 mg/cm$^2$ per day, and the degradation rate in a 7% KCl solution at 93° C. was 1100 mg/cm$^2$ per day.

Example 7

A stock shape having an outer diameter of 10 mm was obtained in the same manner as in Example 1 from a magnesium alloy material including 9 wt. % of aluminum as a metal material, and 0.6 wt. % of zinc, 2 wt. % of calcium, and 0.2 wt. % of nickel as a degradation accelerator.

When an average crystal grain size of the obtained stock shape was measured in the same manner as in Example 1, the average crystal grain size was from 10 to 100 μm.

When tensile strength and a degradation rate of the stock shape of Example 7 were measured in the same manner as in Example 1, the tensile strength was 300 MPa, the degradation rate in a 2% KCl solution at 93° C. was 1922 mg/cm$^2$ per day, and the degradation rate in a 7% KCl solution at 93° C. was 1942 mg/cm$^2$ per day.

Example 8

A stock shape having an outer diameter of 10 mm was obtained in the same manner as in Example 1 from a magnesium alloy material including 9 wt. % of aluminum as a metal material, and 0.5 wt. % of zinc and 0.012 wt. % of nickel as a degradation accelerator.

When an average crystal grain size of the obtained stock shape was measured in the same manner as in Example 1, the average crystal grain size was from 100 to 200 μm.

When tensile strength and a degradation rate of the stock shape of Example 8 were measured in the same manner as in Example 1, the tensile strength was 319 MPa, the degradation rate in a 1% KCl solution at 93° C. was 104 mg/cm$^2$ per day, the degradation rate in a 2% KCl solution at 93° C. was 1230 mg/cm$^2$ per day, and the degradation rate in a 7% KCl solution at 93° C. was 280 mg/cm$^2$ per day.

Furthermore, when a square PGA stock shape measuring approximately 15 mm on a side and a square Mg stock shape measuring 10 mm on a side were immersed in a 2% KCl aqueous solution at 93° C. and a degradation rate of the Mg stock shape was measured, the degradation rate of the Mg stock shape was 666 mg/cm$^2$ per day. A degradation rate obtained when the PGA stock shape and the Mg stock shape were immersed in a 0.05% KCl solution was 100 mg/cm$^2$, and a degradation rate obtained when the PGA stock shape and the Mg stock shape were immersed in ion-exchanged water was 50 mg/cm$^2$.

Example 9

A stock shape having an outer diameter of 10 mm was obtained in the same manner as in Example 1 from a magnesium alloy material including 9 wt. % of aluminum as a metal material, and 1 wt. % of zinc and 16 wt. % of iron as a degradation accelerator.

When an average crystal grain size of the obtained stock shape was measured in the same manner as in Example 1, the average crystal grain size was from 50 to 100 μm.

When tensile strength and a degradation rate of the stock shape of Example 9 were measured in the same manner as in Example 1, the tensile strength was 276 MPa, the degradation rate in a 2% KCl solution at 93° C. was 365 mg/cm$^2$ per day, and the degradation rate in a 7% KCl solution at 93° C. was 397 mg/cm$^2$ per day.

Example 10

A stock shape having an outer diameter of 10 mm was obtained in the same manner as in Example 1 from a magnesium alloy material including 9 wt. % of aluminum as a metal material, and 1 wt. % of zinc and 10 wt. % of copper as a degradation accelerator.

When an average crystal grain size of the obtained stock shape was measured in the same manner as in Example 1, the average crystal grain size was from 50 to 100 μm.

When tensile strength and a degradation rate of the stock shape of Example 10 were measured in the same manner as in Example 1, the tensile strength was 345 MPa, the degradation rate in a 2% KCl solution at 93° C. was 50 mg/cm$^2$ per day, and the degradation rate in a 7% KCl solution at 93° C. was 76 mg/cm$^2$ per day.

Example 11

A stock shape having an outer diameter of 10 mm was obtained in the same manner as in Example 1 from a magnesium alloy material including 8 wt. % of aluminum as a metal material, and 0.5 wt. % of nickel as a degradation accelerator.

When an average crystal grain size of the obtained stock shape was measured in the same manner as in Example 1, the average crystal grain size was from 10 to 100

When tensile strength and a degradation rate of the stock shape of Example 11 were measured in the same manner as in Example 1, the tensile strength was 340 MPa, the degradation rate in a 1% KCl solution at 93° C. was 1214 mg/cm$^2$ per day, the degradation rate in a 2% KCl solution at 93° C. was 1416 mg/cm$^2$ per day, and the degradation rate in a 7% KCl solution at 93° C. was 1840 mg/cm$^2$ per day.

Example 12

Anodizing treatment was performed by a method set forth in JIS H 8651 on the stock shape obtained in Example 1 and including a square surface measuring 10 mm on a side, and an anodized film was formed. When a degradation rate was measured in the same manner as in Example 1, the degradation rate in a 2% KCl solution at 93° C. was 0 mg/cm$^2$ per day. The stock shape was immersed in an acidic aqueous solution at pH 3 to dissolve the film, and then the stock shape degraded in the same manner as in Example 1.

Example 13

The stock shape obtained in Example 1 and including a square surface measuring 10 mm on a side was sprayed with modified PTFE dissolved in a solvent, and was heated at 300° C. This operation was performed twice. When a degradation rate was measured in the same manner as in Example 1, the degradation rate in a 2% KCl solution at 93° C. was 0 mg/cm$^2$ per day. When a coating layer on the surface was peeled, the stock shape degraded in the same manner as in Example 1.

Example 14

The stock shape obtained in Example 1 and including a square surface measuring 10 mm on a side was coated with polyethylene powder by fluidized bed coating. When a degradation rate was measured in the same manner as in Example 1, the degradation rate in a 2% KCl solution at 93° C. was 0 mg/cm$^2$ per day. When a coating layer on the surface was peeled, the stock shape degraded in the same manner as in Example 1.

Comparative Example 1

When a crystal grain size and tensile strength of commercially available pure magnesium were measured, the crystal grain size was from 10 to 50 μm and the tensile strength was 190 MPa. When a degradation rate of the pure magnesium was measured in the same manner as in Example 1, the degradation rate in a 15% KCl solution at 93° C. was 17 mg/cm$^2$ per day.

Comparative Example 2

When a crystal grain size and tensile strength of a commercially available AZ31 magnesium alloy were measured, the crystal grain size was from 10 to 50 μm and the tensile strength was 255 MPa. When a degradation rate of the pure magnesium was measured in the same manner as in Example 1, the degradation rate in a 15% KCl solution at 93° C. was 2 mg/cm$^2$ per day.

INDUSTRIAL APPLICABILITY

The present invention can be used in the field of drilling in natural resource development.

REFERENCE SIGNS LIST

1 Mandrel
2 Diameter-expandable annular rubber component
3, 3' Slip
4, 4' Backup ring
5 Load ring
6, 6' Cone
7 Shear sub
8 Bottom
9 Ball

The invention claimed is:

1. A stock shape for a downhole tool component, the stock shape comprising a magnesium alloy including a phase containing not less than 70 wt. % and not greater than 95 wt. % of magnesium in which not less than 0 wt. % and less than 0.3 wt. % of a rare earth metal, a metal material other than the magnesium and the rare earth metal, and not less than 0.1 wt. % and not greater than 20 wt. % of a degradation accelerator are distributed;

wherein the stock shape has an average crystal grain size of the magnesium alloy of not less than 0.1 μm and not greater than 300 μm, tensile strength of not less than 200 MPa and not greater than 500 MPa, and a degradation rate in a 2% potassium chloride aqueous solution at 93° C. of not less than 20 mg/cm$^2$ and not greater than 20000 mg/cm$^2$ per day.

2. The stock shape for a downhole tool component according to claim 1, wherein an average particle size of the metal material and the degradation accelerator is not greater than 100 μm.

3. The stock shape for a downhole tool component according to claim 1, wherein the tensile strength is not less than 300 MPa and not greater than 500 MPa.

4. The stock shape for a downhole tool component according to claim 1, wherein a ratio of a degradation rate in a 2% potassium chloride aqueous solution at 93° C. and a degradation rate in a 7% potassium chloride aqueous solution at 93° C. is from 1.01:1 to 3.0:1.

5. The stock shape for a downhole tool component according to claim 1, wherein the metal material includes at least one metal selected from the group consisting of aluminum and zirconium.

6. The stock shape for a downhole tool component according to claim 1, the stock shape comprising:

aluminum as the metal material and zinc as the degradation accelerator; and having a content of the aluminum of not less than 3 wt. % and not greater than 15 wt. %, and a content of the zinc of less than 0.1 wt. % and not greater than 5 wt. %.

7. The stock shape for a downhole tool component according to claim 1, wherein the stock shape has an outer diameter of not less than 30 mm and not greater than 200 mm.

8. The stock shape for a downhole tool component according to claim 1, wherein the degradation accelerator includes at least one metal selected from the group consisting of iron, nickel, copper, cobalt, zinc, cadmium, calcium, and silver.

9. The stock shape for a downhole tool component according to claim 8, comprising at least one selected from the group consisting of iron, nickel, and copper as the degradation accelerator.

10. A downhole tool component formed with the stock shape for a downhole tool component according to claim 1.

11. The downhole tool component according to claim 10, wherein the downhole tool component serves as a mandrel or a side part.

12. The downhole tool component according to claim 11, wherein the side part serves as at least a portion of a slip, a shear sub, a load ring, a cone, or a side part fixing screw.

13. The downhole tool component according to claim 10, wherein the downhole tool component serves as a sealing component configured to temporarily seal a flow path in a downhole tool, or a portion of the sealing component.

14. The downhole tool component according to claim 13, wherein the sealing component has a ball shape, a screw shape, or a push pin shape.

15. A downhole tool comprising the downhole tool component according to claim 10.

16. The downhole tool according to claim 15, wherein the downhole tool serves as a frac plug or a bridge plug.

17. The downhole tool according to claim 15, further comprising a downhole tool component formed with a degradable resin.

18. The downhole tool according to claim 17, wherein the degradable resin includes polyester.

19. The downhole tool according to claim 18, wherein the polyester includes polyglycolic acid.

20. The downhole tool according to claim 15, further comprising a downhole tool component formed with a degradable rubber.

21. A well treatment method using the downhole tool according to claim 15.

* * * * *